US007855542B2

(12) United States Patent
Heilmann

(10) Patent No.: US 7,855,542 B2
(45) Date of Patent: Dec. 21, 2010

(54) VOLTAGE REGULATOR STARTUP METHOD AND APPARATUS

(75) Inventor: Benjamin Heilmann, Raleigh, NC (US)

(73) Assignee: Qimonda AG, Munich (DE)

( * ) Notice: Subject to any disclaimer, the term of this patent is extended or adjusted under 35 U.S.C. 154(b) by 690 days.

(21) Appl. No.: 11/778,799

(22) Filed: Jul. 17, 2007

(65) Prior Publication Data

US 2009/0021308 A1 Jan. 22, 2009

(51) Int. Cl.
*G05F 3/16* (2006.01)
*G05F 1/40* (2006.01)

(52) U.S. Cl. ..... 323/316; 323/281; 327/539

(58) Field of Classification Search ..... 323/312–316, 323/280, 281; 327/534, 535, 538–543
See application file for complete search history.

(56) References Cited

U.S. PATENT DOCUMENTS 4,176,308 A 11/1979 Dobkin et al.
5,345,422 A 9/1994 Redwine
5,666,044 A * 9/1997 Tuozzolo ..... 323/277
5,686,824 A 11/1997 Rapp
6,188,210 B1 2/2001 Tichauer et al.
7,034,569 B1 4/2006 Balasubramanian et al.
7,102,437 B2 * 9/2006 Perry ..... 330/259
7,116,088 B2 10/2006 Tran et al.
2003/0206422 A1 11/2003 Gucyski
2003/0218454 A1 11/2003 Cunnac et al.
2004/0245975 A1 12/2004 Tran et al.
2006/0071703 A1 4/2006 Chatterjee et al.
2006/0104001 A1 5/2006 Yoshio
2007/0001657 A1 1/2007 Mellachurvu et al.

* cited by examiner

*Primary Examiner*—Jessica Han
(74) *Attorney, Agent, or Firm*—Coats & Bennett, P.L.L.C.

(57) ABSTRACT

A voltage regulator circuit comprises an amplifier, bias network and startup circuit. The bias network is configured to generate a bias voltage for setting a bias current in the amplifier. The startup circuit is configured to mirror the amplifier bias current and to assist the bias network in setting the amplifier bias current based on the mirrored amplifier bias current until the bias voltage approximates a desired level.

21 Claims, 4 Drawing Sheets

VOLTAGE REGULATOR STARTUP METHOD AND APPARATUS

BACKGROUND OF THE INVENTION

Voltage regulators include an amplifier for generating a regulated voltage corresponding to the difference between a reference voltage input and a regulator feedback voltage. Also included are a power transistor which is driven by the amplifier and a bias network. The power transistor boosts the amplifier output to generate a regulated voltage output, which is fed back to the amplifier as the feedback voltage. The bias network sets the bias current in the amplifier based on one or more bias voltages generated by the network. Voltage regulators are at least partially disabled from time-to-time to reduce power consumption when load currents are low and steady, e.g., during low power or standby modes. When a voltage regulator is disabled, the amplifier bias current is substantially reduced to lower power consumption.

One conventional approach for disabling a voltage regulator is to set the gate-to-source voltage of the regulator power transistor to zero volts, thus turning off the power transistor. A switch may also prevent current flow through the bleeder resistor coupled to the power transistor. The regulator amplifier is also disabled by disconnecting the main bias voltage applied to the bias network, thus disabling the bias network. Each output node of the bias network is driven to an appropriate voltage level when the bias network is disabled to ensure that the amplifier is properly disabled. This way, the bias voltages applied to the amplifier do not float to problematic levels.

When the voltage regulator is subsequently re-enabled, the bias network charges the internal capacitance of the amplifier from a disabled state to a desired level before the amplifier can generate a properly regulated output. Some conventional voltage regulators include a startup circuit such as a boost capacitor network for assisting the bias network in setting the amplifier bias current during regulator re-enablement. The startup circuit helps in charging/discharging the bias voltages from their disabled levels to their proper operating levels.

However, conventional regulator startup circuits are highly process, voltage and temperature (PVT) dependent. For example, switch resistance and boost capacitance vary over process and temperature conditions. Also, the initial boost voltage provided by such circuits varies greatly with supply voltage. PVT-induced variations in startup circuit operation are conventionally unrelated to PVT-induced variations in bias network operation. That is, conventional startup circuits do not behave the same way as bias networks in response to varying PVT conditions. The regulator amplifier may not be properly enabled when the bias network and startup circuit behave differently under changing PVT conditions. The output of the regulator may fall outside acceptable limits required for proper circuit operation when the regulator is not properly enabled.

SUMMARY OF THE INVENTION

A voltage regulator circuit comprises an amplifier, bias network and startup circuit. The bias network is configured to generate a bias voltage for setting a bias current in the amplifier. The startup circuit is configured to mirror the amplifier bias current and to assist the bias network in setting the amplifier bias current based on the mirrored amplifier bias current until the bias voltage approximates a desired level.

Of course, the present invention is not limited to the above features and advantages. Those skilled in the art will recognize additional features and advantages upon reading the following detailed description, and upon viewing the accompanying drawings.

DETAILED DESCRIPTION OF THE INVENTION

Figure 1:
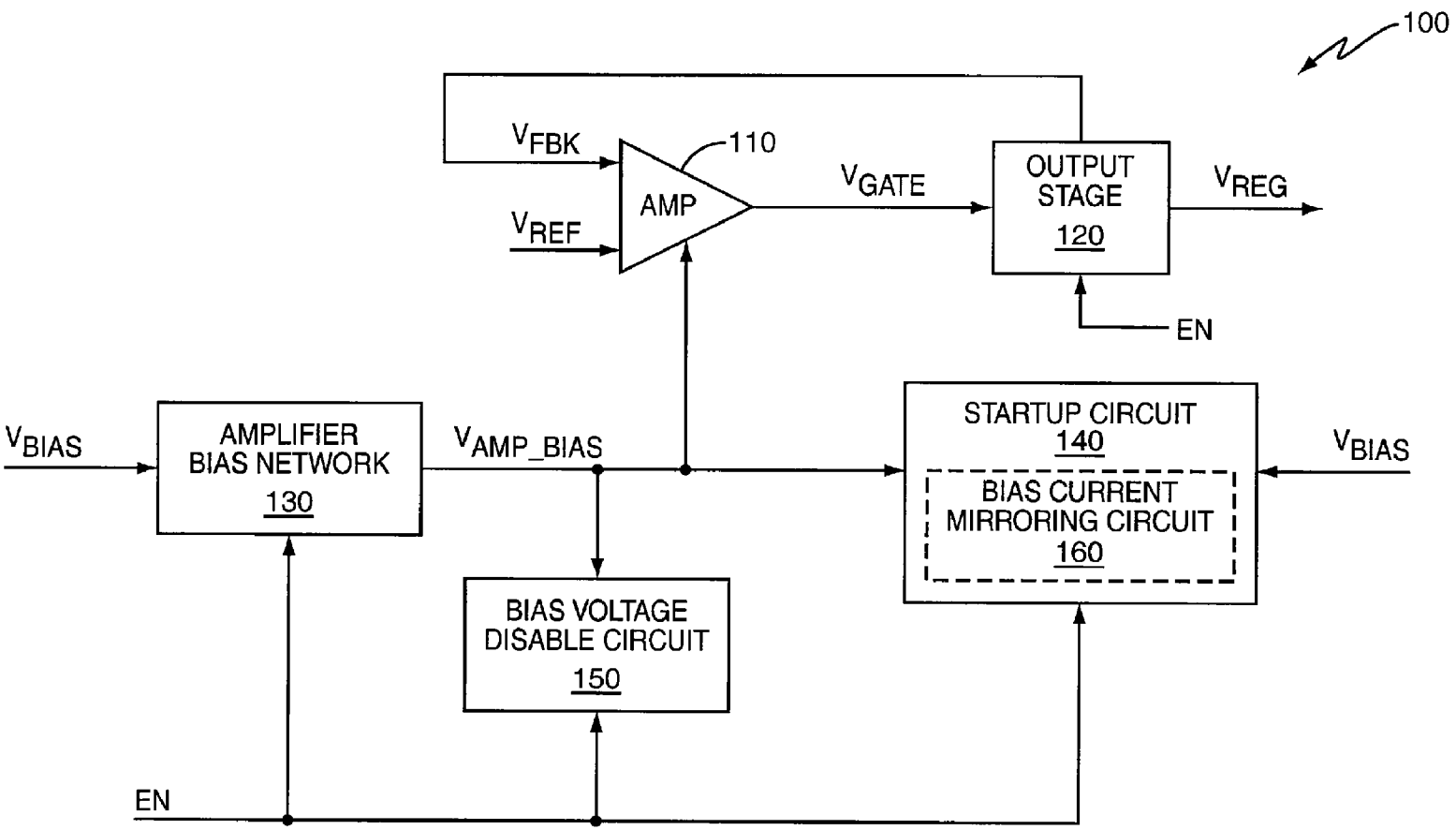
FIG. 1 is a block diagram of an embodiment of a voltage regulator circuit including an amplifier bias current monitoring circuit.

FIG. 1 illustrates an embodiment of a voltage regulator circuit 100 having an amplifier 110, output stage 120, bias network 130, and startup circuit 140. The amplifier 110 generates a regulated voltage ($V_{GATE}$) in response to the difference between a reference voltage input ($V_{REF}$) and a feedback voltage ($V_{FBK}$). The output stage 120 boosts the amplifier output to generate a regulated voltage output ($V_{REG}$), which is fed back to the amplifier 110 as the feedback voltage in one embodiment. The bias network 130 generates on one or more amplifier bias voltages ($V_{AMP_BIAS}$) in response to a bias voltage ($V_{BIAS}$) applied to the bias network 130. The amplifier bias voltages set the bias current flowing through the amplifier 110. An enable signal (EN) may cause the voltage regulator 100 to be disabled from time-to-time, e.g., when load currents are low and steady such as during low power or standby modes. A bias voltage disable circuit 150 pulls each bias voltage to a desired level when the regulator 100 is disabled for placing the amplifier 110 in a known, non-problematic state.

When the regulator 100 is subsequently re-enabled, the bias network 130 begins to set the amplifier bias current by pulling each bias voltage from its disabled level to the proper operating level. The startup circuit 140 assists the bias network 130 in setting the amplifier bias current. To this end, a bias current mirroring circuit 160 included in or associated with the startup circuit 140 mirrors one or more bias currents flowing in the amplifier 110. In one embodiment, the main amplifier bias current is mirrored. In other embodiments, multiple amplifier bias currents are mirrored, e.g., one bias current may be monitored for each stage of a multi-stage amplifier 110.

Regardless, the bias current mirroring circuit 160 has the same or similar architecture as the bias network 130. As such, the current flowing through the mirroring circuit 160 is proportional to the amplifier bias current being mirrored. That is, the mirrored bias current has fluctuations that substantially mimic those of the corresponding amplifier bias current. The mirrored bias current may be approximately of the same magnitude as the tracked amplifier bias current or a scaled version to reduce power consumption. Further, the startup circuit 140 experiences the same or similar PVT-induced current and voltage fluctuations as the bias network 130. As such, the bias currents and voltages generated by the bias network 130 and startup circuit 140 are similar, ensuring more reliable voltage regulator operation.

The startup circuit 140 provides assistance to the bias network 130 in proportion to the magnitude of the current flowing through the bias current mirroring circuit 160. As the bias voltage which sets the amplifier bias current being mirrored approaches its proper operating level, the startup circuit 140 reduces the assistance provided to the bias network 130. For ease of description only, operation of the voltage regulator 100 is described next in more detail with reference to a folded cascode amplifier. However, those skilled in the art will readily recognize that the regulator startup teachings disclosed herein apply equally to other amplifier topologies, and thus the following discussion should be considered non-limiting.

Figure 2:
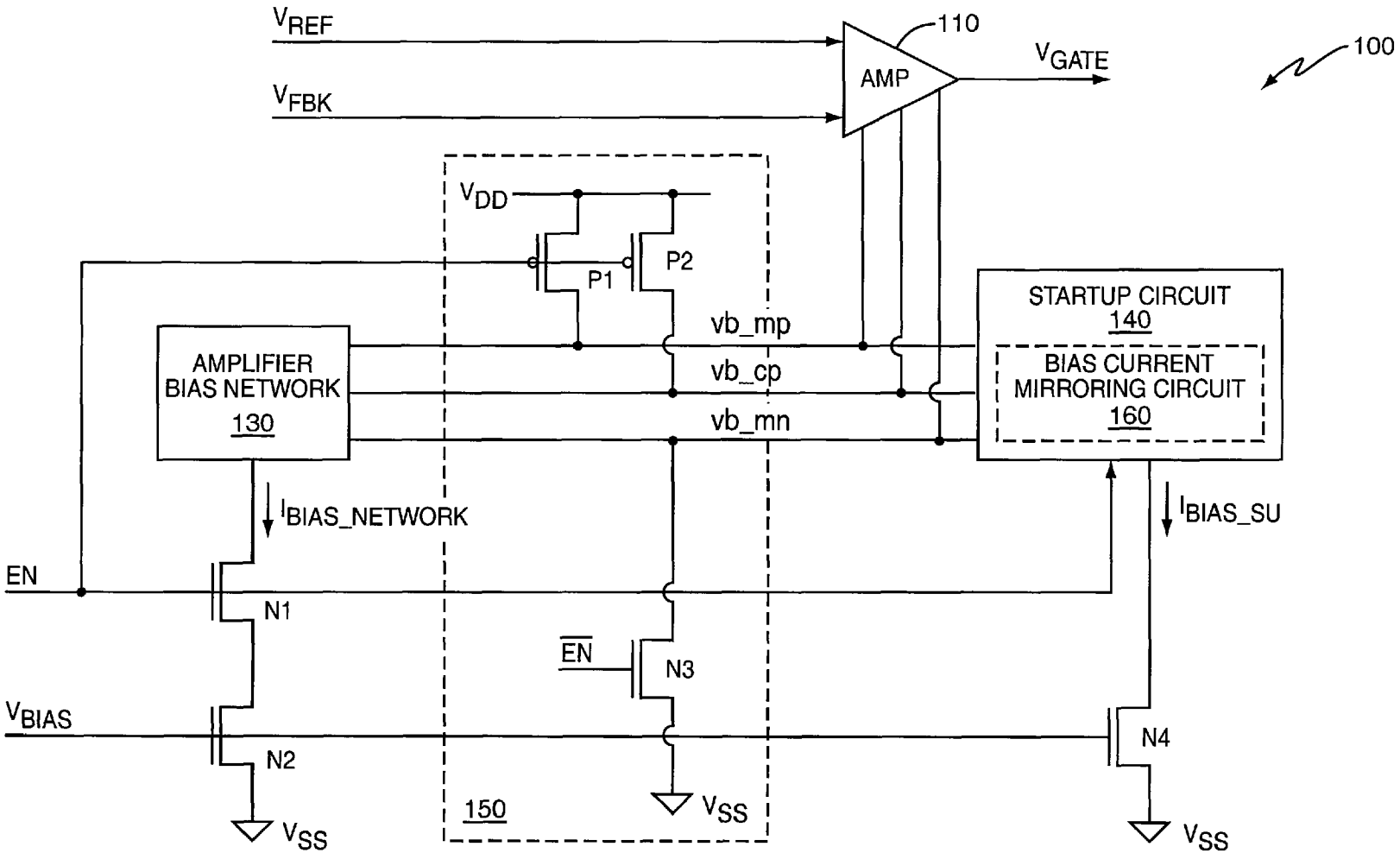
FIG. 2 is a block diagram of another embodiment of a voltage regulator circuit including an amplifier bias current monitoring circuit.

With this understanding, FIG. 2 illustrates an embodiment of the voltage regulator 100 where the amplifier 110 has a folded cascode topology. The bias network 130 generates at least three amplifier bias voltages (vb_mp, vb_cp, vb_mn) in response to $V_{BIAS}$. The first bias voltage (vb_mp) sets the primary bias current in the amplifier 110. The second bias voltage (vb_cp) controls operation of cascode transistor devices included in the amplifier 110, e.g., pfet devices. The third bias voltage (vb_mn) controls operation of complimentary transistor devices included in the amplifier 110, e.g., nfet devices.

During normal regulator operation, the bias network 130 sets the bias voltage levels while the startup circuit 140 provides negligible assistance or is altogether disconnected from the bias network 130. For example, the bias network 130 maintains the first and second bias voltages (vb_mp, vb_cp) at a sufficiently elevated level to ensure proper pfet device operation in the amplifier 110 and maintains the third bias voltage (vb_mn) at a sufficiently low level to ensure proper nfet device operation. When the regulator 100 is disabled, a first nfet device N1 included in the bias voltage disable circuitry 150 prevents bias current ($I_{BIAS_NETWORK}$) from flowing in the bias network 130 responsive to the enable signal (EN) being deactivated. Particularly, a second nfet device N2 is prevented from setting the bias network current when the first nfet N1 is switched off. Pfet devices P1 and P2 included in the bias voltage disable circuitry 150 pull-up the first and second bias voltages to $V_{DD}$ while a third nfet device N3 pulls-down the third bias voltage to $V_{SS}$. This way, pfet and nfet devices included in the amplifier 110 are properly deactivated when the regulator 100 is disabled.

Bias current continues to flow in the startup circuit 140 when the regulator 100 is disabled. A fourth nfet device N4 sets the startup circuit bias current ($I_{BIAS_SU}$) in response to the same bias voltage ($V_{BIAS}$) applied to the bias network 130 or a different bias voltage. The startup circuit 140 is in a reset state when the regulator 100 is disabled. This way, the startup circuit 140 is ready to assist the bias network 130 upon re-enablement of the regulator 100. In one embodiment, the startup circuit 140 is placed in a state that will allow the startup circuit 140 to generate a current when the regulator 100 is re-enabled. The current flowing in the startup circuit 140 helps the bias network 130 pull the main bias voltage (vb_mp) from its disabled state ($V_{DD}$) to its proper operating level, thus providing a sufficient main bias current in the amplifier 110.

At the same time, the bias current mirroring circuit 160 generates a current mirroring the main amplifier bias current. Of course, a different amplifier bias current may be mirrored. As the main bias voltage begins to approach its proper operating level, the magnitude of the mirrored bias current changes proportionally, thus tracking changes in the main amplifier bias current. The startup circuit 140 reduces the assistance provided to the bias network 130 as the main bias voltage approaches its proper operating level. When the proper main bias voltage level is reached, the startup circuit 140 provides negligible assistance to the bias network 130. In some embodiments, the regulator startup circuit 140 is decoupled from the bias network 140 when the proper bias voltage level is reached.

Figure 3:
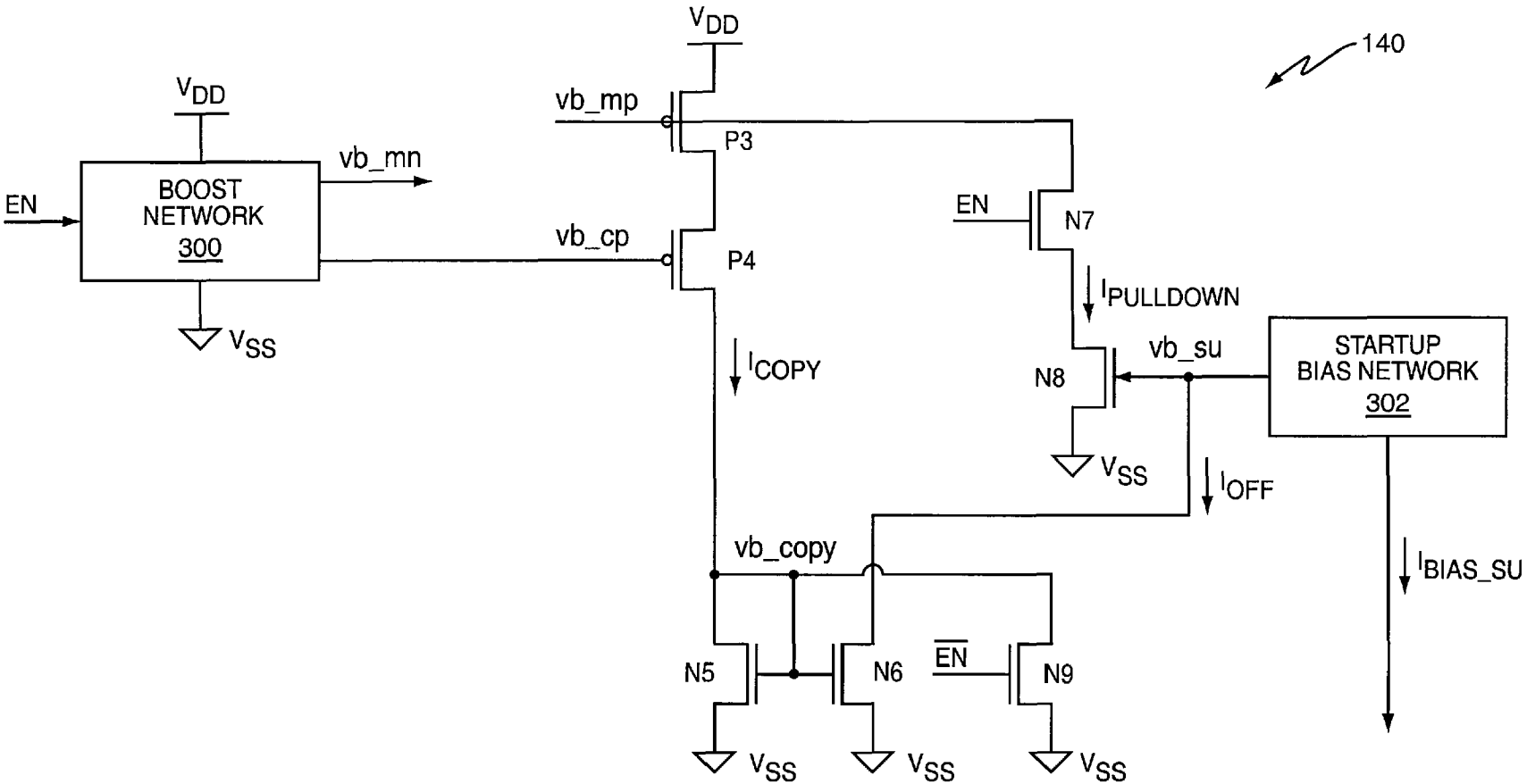
FIG. 3 is a block diagram of an embodiment of a voltage regulator startup circuit and an amplifier bias current monitoring circuit.

FIG. 3 illustrates an embodiment of the regulator startup circuit 140. The startup circuit 140 assists the bias network 130 in setting the main amplifier bias current when the voltage regulator 100 is re-enabled. The startup circuit 140 assists the bias network 130 based on a mirrored copy of the amplifier bias current ($I_{COPY}$) generated by the bias current mirroring circuit 160. According to this embodiment, the current mirroring circuit 160 comprises a copy of a folded cascode branch of the amplifier 110. Particularly, the current mirroring circuit 160 includes two pfet devices P3 and P4 coupled in series with an nfet device N5. Pfet device P3 is actuated by the main amplifier bias voltage (vb_mp) and pfet device P4 is actuated by the cascode amplifier bias voltage (vb_cp). As pfet devices P3 and P4 begin to turn on, nfet device N5 also begins to turn on. In other embodiments, the bias current mirroring circuit 160 is based on non-folded cascode amplifier topologies. The current mirroring circuit 160 may also mirror other bias currents flowing in the amplifier 110.

Regardless, the startup circuit 140 includes a boost network 300 such as one or more boost capacitors. The second (vb_cp) and third (vb_mn) amplifier bias voltages are boosted by the boost network 300 when the regulator 100 is re-enabled. The boost network 300 helps the amplifier bias network 130 discharge the second bias voltage from its high disabled state and charge the third bias voltage from its low disabled state. The bias network 130 also begins to set the main amplifier bias current by pulling the main bias voltage (vb_mp) to its proper operating level, e.g., as illustrated by Step 400 of FIG. 4.

Figure 4:
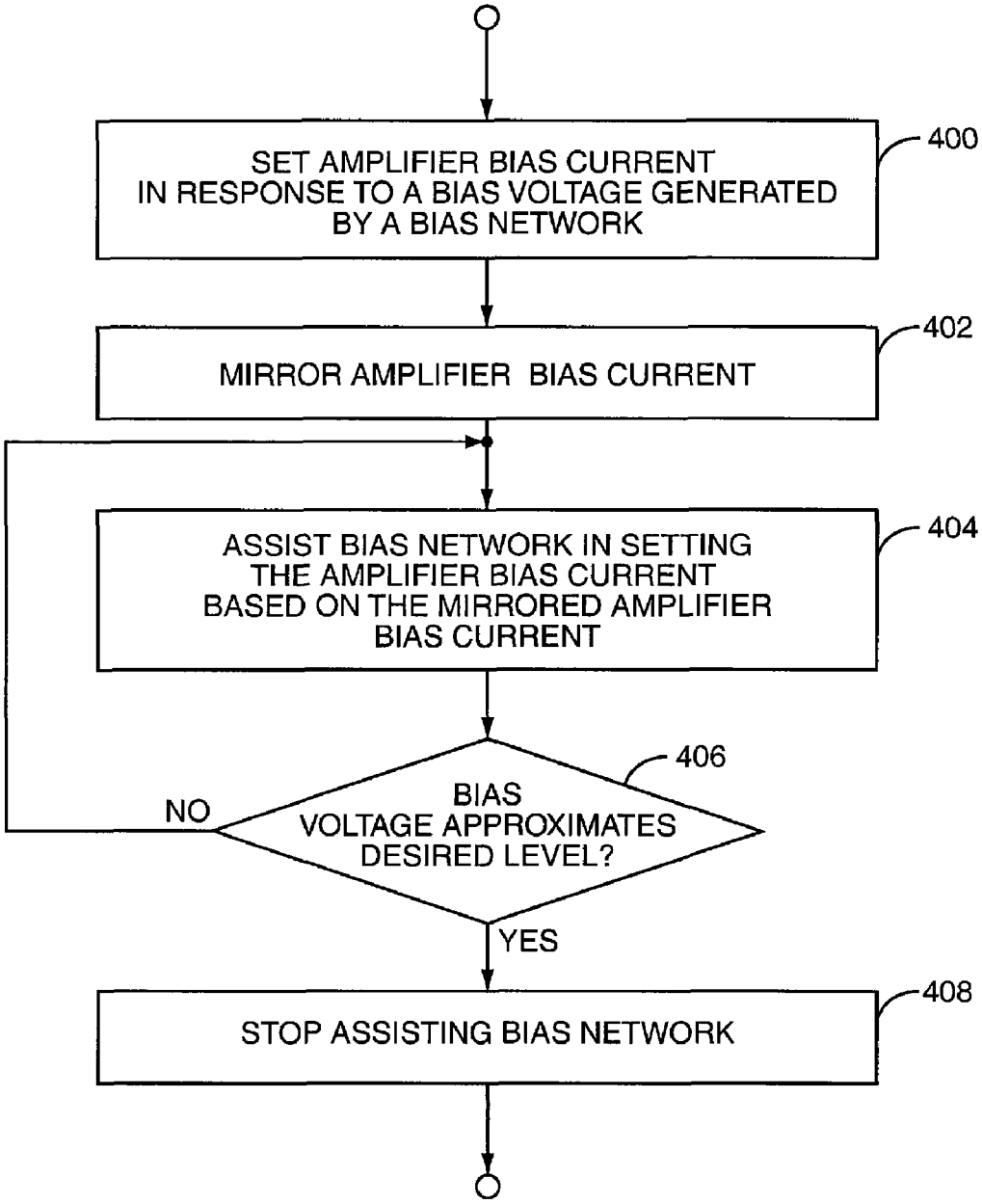
FIG. 4 is a logic flow diagram of an embodiment of program logic for enabling a voltage regulator circuit.

In response, the bias current mirroring circuit 160 mirrors the main amplifier bias current, e.g., as illustrated by Step 402 of FIG. 4. In one embodiment, pfet devices P3 and P4 and nfet device N5 are approximately the same size as the corresponding transistors included in the amplifier branch being mirrored. This way, the mirrored bias current ($I_{COPY}$) has the same magnitude as the main amplifier bias current. In another embodiment, pfet devices P3 and P4 and nfet device N5 are scaled using appropriate W/L ratios to reduce power consumption. Either way, devices P3, P4 and N5 provide a current that mirrors fluctuations in the main bias current flowing in the amplifier 110.

The current flowing through the bias current mirroring circuit 160 is mirrored to nfet device N6. Nfet device N6 is powered by a startup bias voltage (vb_su) generated by a bias network 302 included in or associated with the startup circuit 140. The startup bias voltage is based on a bias current ($I_{BIAS_SU}$) flowing in the startup bias network 302. When the enable signal (EN) is low, the main amplifier bias voltage (vb_mp) is disabled and connected to $V_{DD}$, preventing current flow in the amplifier 110 and the bias current mirroring circuit 160 ($I_{COPY} \approx 0A$). In addition, nfet device N7 decouples the main bias voltage from pull-down nfet device N8. Nfet device N9 shorts the gate voltage of nfet devices N5 and N6 (vb_copy) to $V_{SS}$, turning off nfet devices N5 and N6.

When the enable signal transitions to a high level, the main bias voltage is disconnected from $V_{DD}$ and begins charging to its proper operating level. Nfet device N7 connects pull-down nfet device N8 to the main bias voltage. In response, pull-down nfet device N8 begins to pull the main bias voltage down from $V_{DD}$ with a well defined current ($I_{PULLDOWN}$), e.g., as illustrated by Step 404 of FIG. 4. Nfet device N9 disconnects $V_{SS}$ from the gates of nfet devices N5 and N6.

In response, the voltage applied to the gates of nfet devices N5 and N6 begins to rise from $V_{SS}$ as the mirrored bias current ($I_{COPY}$) permits. As the voltage applied to the gates of nfet devices N5 and N6 increases, nfet device N6 sinks more current ($I_{OFF}$) from the gate node of nfet device N8. Accordingly, the pull-down current flowing through nfet device N7 decreases, reducing the assistance provided by the startup circuit 140 to the bias network 130. When nfet device N6 is sized properly, N6 pulls the gate of nfet N8 low, thus turning off nfet N8 and reducing the pull-down current $I_{PULLDOWN}$ to approximately zero Amps when the main bias voltage approximates its proper operating level, e.g., as illustrated by Step 406 of FIG. 4. Otherwise, the gate voltage of nfet N8 may not be low enough, and thus N8 may still pull current. Also, the regulator 100 starts up very quickly when nfet N8 is sized properly. When nfet N8 is switched off, the startup circuit 140 no longer provides appreciable assistance to the bias network 130, e.g., as illustrated by Step 408 of FIG. 4.

The startup circuit 140 determines when to stop assisting the bias network 130 based on the magnitude of main bias current flowing in the amplifier 110 since the level of the main bias voltage is PVT dependent. The bias currents used in and generated by the startup circuit 140 have the same PVT variation as the main amplifier bias current since the startup bias network 302 generates the same or similar bias voltages as the amplifier bias network 130. As such, the startup circuit 140 helps to pull the main amplifier bias voltage to its proper PVT-dependent operating level using a well-defined current. By mirroring the main bias current flowing through the amplifier 110, the pull-down current ($I_{PULLDOWN}$) flowing in the startup circuit 140 can be disabled when the amplifier 110 achieves a desired operating point.

Of course, the startup circuit 140 may assist the bias network 130 in pulling-up/pulling-down other amplifier bias voltages. In one embodiment, the startup circuit 140 helps pull-up the third bias voltage (vb_mn) from a low disabled state to its proper elevated operating level. Accordingly, a pull-up pfet device (not shown) may be used to generate a pull-up current for increasing the voltage level of the third bias voltage from its low disabled state. The strength of the pull-up current depends on the magnitude of the current flowing through the bias current mirroring circuit 160. The pull-up current is disabled when the third amplifier bias voltage approximates its proper operating level.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A method of enabling a voltage regulator, comprising:

setting an amplifier bias current responsive to a bias voltage provided at an output node of a bias network;

injecting a second current generated based on a mirrored version of the amplifier bias current into the bias network output node for assisting the bias network in pulling the bias voltage toward a desired level; and reducing the second current responsive to the bias voltage approaching the desired level.

2. The method of claim 1, wherein injecting the second current into the bias network output node comprises injecting a current generated based on a scaled version of the amplifier bias current.

3. The method of claim 1, wherein reducing the second current responsive to the bias voltage approaching the desired level comprises decreasing the gate-to-source voltage applied to a transistor configured to provide the second current responsive to the mirrored version of the amplifier bias current increasing in magnitude.

4. A voltage regulator circuit, comprising:

an amplifier;

a bias network having an output node configured to provide a bias voltage for setting a bias current in the amplifier;

a startup circuit configured to:

inject a second current generated based on a mirrored version of the amplifier bias current into the bias network output node for assisting the bias network in pulling the bias voltage toward a desired level; and reduce the second current responsive to the bias voltage approaching the desired level.

5. The voltage regulator circuit of claim 4, wherein the startup circuit is configured to inject a current generated based on a scaled version of the amplifier bias current into the bias network output node.

6. The voltage regulator circuit of claim 4, wherein the startup circuit is configured to decrease the gate-to-source voltage applied to a transistor configured to provide the second current responsive to the mirrored version of the amplifier bias current increasing in magnitude.

7. A method of enabling a voltage regulator, comprising:

pulling a bias voltage from a disabled level to a predetermined level by a bias network being re-enabled from a disabled state;

setting a bias current in an amplifier stage of the voltage regulator based on the bias voltage generated by the bias network;

mirroring the bias current to generate a mirrored bias current; and assisting the bias network in setting the bias current in the amplifier stage based on the mirrored bias current while the bias network is being re-enabled from the disabled state.

8. The method of claim 7, wherein mirroring the bias current comprises generating a scaled version of the bias current.

9. The method of claim 7, wherein mirroring the bias current comprises generating the mirrored bias current responsive to the bias voltage.

10. The method of claim 7, wherein assisting the bias network in setting the bias current in the amplifier stage based on the mirrored bias current comprises assisting the bias network in pulling the bias voltage to the predetermined level.

11. The method of claim 10, wherein assisting the bias network in pulling the bias voltage to the predetermined level comprises:

increasing the mirrored bias current responsive to the bias voltage deviating from the predetermined level; and decreasing the mirrored bias current responsive to the bias voltage approaching the predetermined level.

12. The method of claim 7, comprising assisting the bias network in setting a plurality of bias currents in the amplifier stage based on the mirrored bias current while the bias network is being re-enabled from the disabled state.

13. The method of claim 7, further comprising decoupling the mirrored bias current from the amplifier stage of the voltage regulator when the bias voltage is set to the predetermined level.

14. A voltage regulator circuit, comprising:

an amplifier;

a bias network configured to pull a bias voltage from a disabled level to a predetermined level responsive to being re-enabled from a disabled state and set a bias current in the amplifier based on the bias voltage; and a startup circuit configured to mirror the bias current to generate a mirrored bias current and assist the bias network in setting the bias current in the amplifier based on the mirrored bias current while the bias network is being re-enabled from the disabled state.

15. The voltage regulator circuit of claim 14, wherein the startup circuit is configured to generate a scaled version of the bias current.

16. The voltage regulator circuit of claim 14, wherein the startup circuit is configured to generate the mirrored bias current responsive to the bias voltage.

17. The voltage regulator circuit of claim 14, wherein the startup circuit is configured to assist the bias network in pulling the bias voltage to the predetermined level.

18. The voltage regulator circuit of claim 17, wherein the startup circuit is configured to increase the mirrored bias current responsive to the bias voltage deviating from the predetermined level and decrease the mirrored bias current responsive to the bias voltage approaching the predetermined level.

19. The voltage regulator circuit of claim 14, wherein the startup circuit is configured to assist the bias network in setting a plurality of bias currents in the amplifier stage based on the mirrored bias current while the bias network is being re-enabled from the disabled state.

20. The voltage regulator circuit of claim 14, wherein the startup circuit is configured to be decoupled from the amplifier when the bias voltage is set to the predetermined level.

21. A voltage regulator circuit, comprising:

an amplifier;

a bias network configured to pull a bias voltage from a disabled level to a predetermined level responsive to the bias network being re-enabled from a disabled state and set a bias current in the amplifier based on the bias voltage; and means for mirroring the bias current to generate a mirrored bias current and assisting the bias network in setting the bias current in the amplifier based on the mirrored bias current while the bias network is being re-enabled from the disabled state.

* * * * *